US007946202B2

(12) United States Patent
Lin

(10) Patent No.: US 7,946,202 B2
(45) Date of Patent: May 24, 2011

(54) GRIP FOR PLIERS

(76) Inventor: Chia-Yun Lin, Taichung (TW)

( * ) Notice: Subject to any disclaimer, the term of this patent is extended or adjusted under 35 U.S.C. 154(b) by 50 days.

(21) Appl. No.: 12/582,869

(22) Filed: Oct. 21, 2009

(65) Prior Publication Data

US 2011/0088521 A1 Apr. 21, 2011

(51) Int. Cl.
*B25B 7/00* (2006.01)
*B25G 1/10* (2006.01)

(52) U.S. Cl. ..... 81/427.5; 16/430

(58) Field of Classification Search ..... 81/427.5, 81/489, 415–417, 177.1, 177.6; 16/430; D8/107, 52, 80, 83, 84, 94, 97, 303, 315, D8/317, 318, 322

See application file for complete search history.

(56) References Cited

U.S. PATENT DOCUMENTS

| | | | | | |
|---|---|---|---|---|---|
| 3,713,350 | A | * | 1/1973 | Brilando | 74/551.9 |
| 4,829,858 | A | * | 5/1989 | Kern et al. | 81/427.5 |
| D404,280 | S | * | 1/1999 | Wen | D8/107 |
| D405,677 | S | * | 2/1999 | Mosley | D8/107 |
| D464,245 | S | * | 10/2002 | Jacquet | D8/99 |
| 2009/0271951 | A1 | * | 11/2009 | Hao | 16/430 |

* cited by examiner

*Primary Examiner* — Hadi Shakeri
(74) *Attorney, Agent, or Firm* — WPAT, P.C.; Anthony King

(57) ABSTRACT

A grip for pliers has a body and a bow. The body has an inner side, an outer side, a handle hole, a curved cushioning hole and a curved cushioning arm. The handle hole is capable of being mounted around a handle of the pliers, is defined in the body and is adjacent to the inner side of the body. The cushioning hole is curved, is defined through the body, is adjacent to the outer side of the body and extends along the handle hole. The cushioning arm is curved and is formed on the outer side of the body. The flexible bow is securely mounted in the cushioning arm and extends along the cushioning arm.

6 Claims, 3 Drawing Sheets

GRIP FOR PLIERS

BACKGROUND OF THE INVENTION

1. Field of the Invention

The present invention relates to a grip for pliers, and more particularly to a grip that can cushion reacting force generated from an object clamped by the pliers.

2. Description of Related Art

A pair of pliers is composed of a pair of metal levers pivotally connected with each other and comprises a joint, two jaws and two handles. A conventional grip for pliers is solid and is mounted securely around one of the handles. However, reacting force will occur and be transmitted to the handles and the solid grip which is held firmly by a user when jaws hold and clamp an object. This causes the pain and uncomforted feeling to the user and is not practical.

To overcome the shortcomings, the present invention tends to provide a grip for pliers to mitigate the aforementioned problems.

SUMMARY OF THE INVENTION

The main objective of the invention is to provide a grip for pliers that can cushion and absorb reacting force generated from an object against jaws and can effectively relieve the pain and uncomforted feeling of hands of a user.

A grip for pliers has a body and a bow. The body has an inner side, an outer side, a handle hole, a curved cushioning hole and a curved cushioning arm. The handle hole is capable of being mounted around a handle of the pliers, is defined in the body and is adjacent to the inner side of the body. The cushioning hole is curved, is defined through the body, is adjacent to the outer side of the body and extends along the handle hole. The cushioning arm is curved and is formed on the outer side of the body. The flexible bow is securely mounted in the cushioning arm and extends along the cushioning arm.

Other objects, advantages and novel features of the invention will become more apparent from the following detailed description when taken in conjunction with the accompanying drawings.

DETAILED DESCRIPTION OF PREFERRED EMBODIMENT

Figure 1:
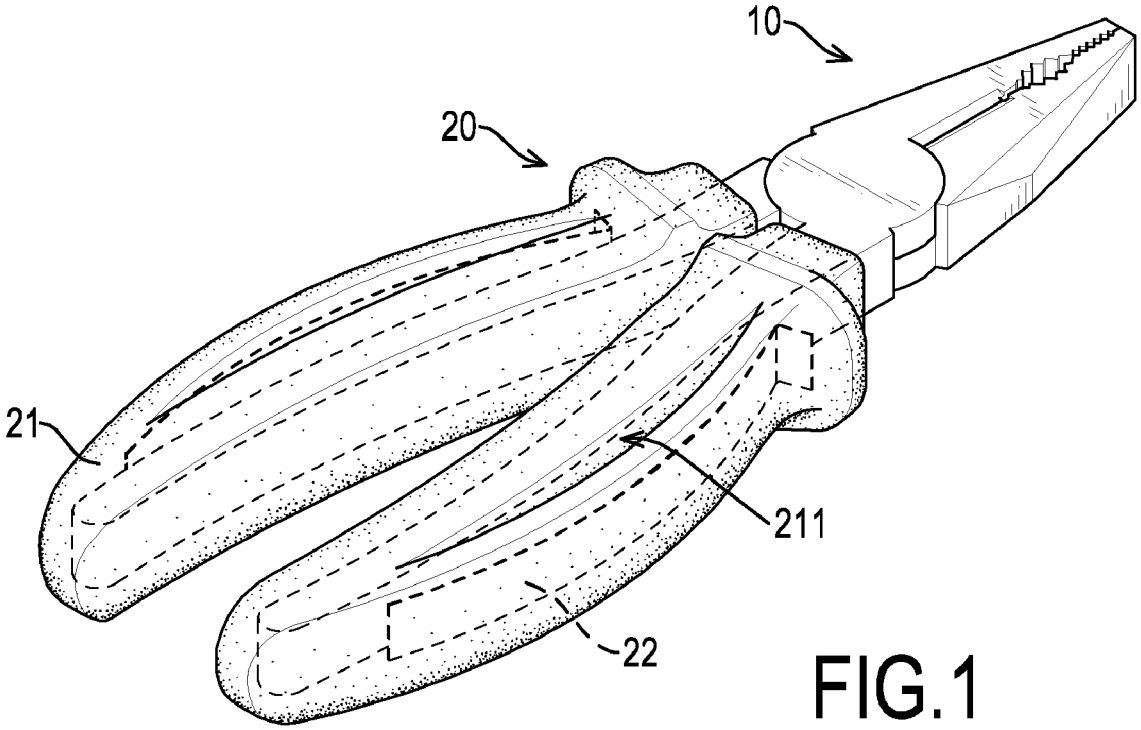
FIG. 1 is a perspective view of a pair of pliers with grips in accordance with the present invention.
Figure 2:
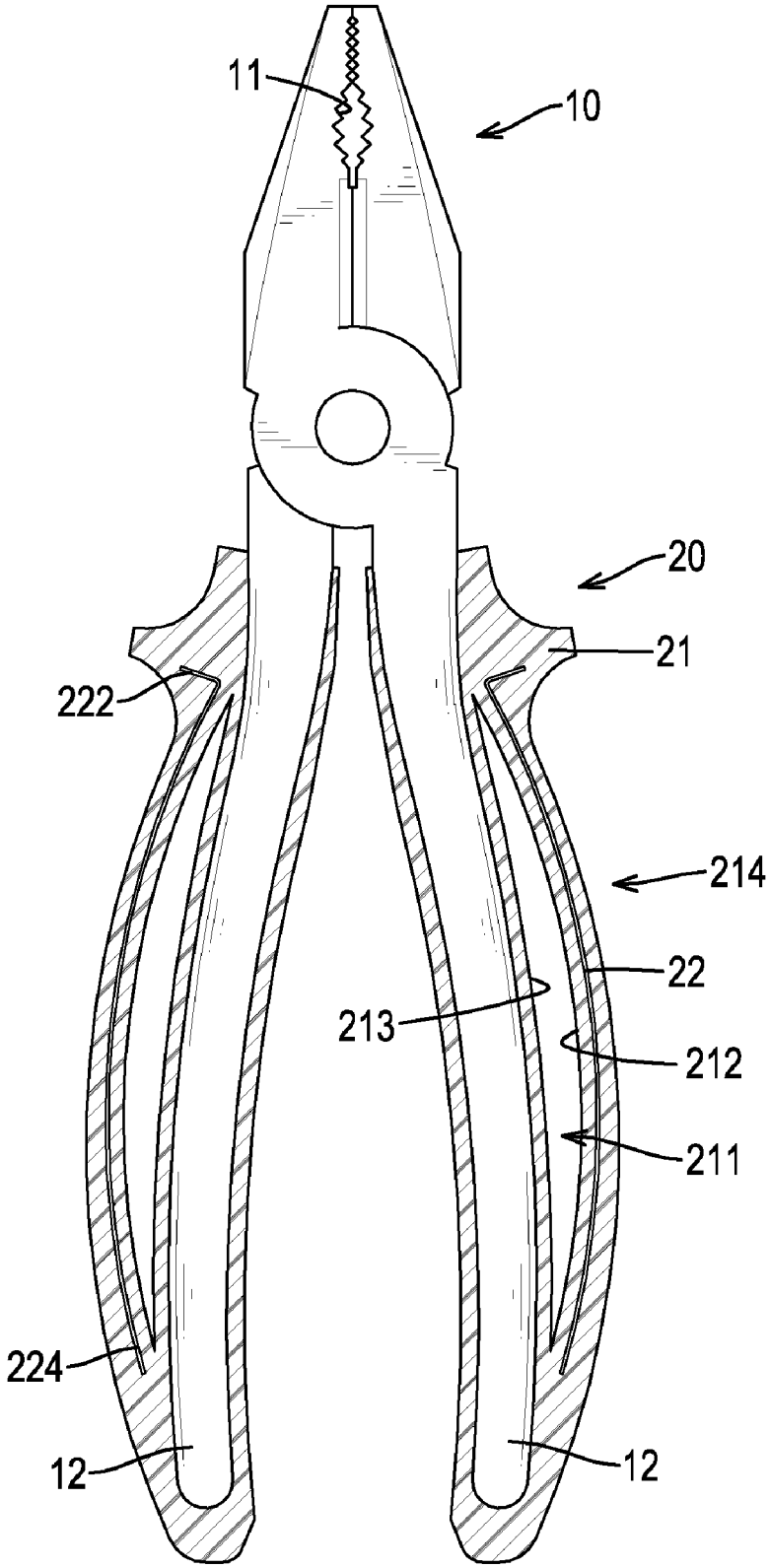
FIG. 2 is a side view in partial section of the pliers with grips in FIG. 1.

With reference to FIGS. 1 and 2, a pair of pliers (10) with grips (20) in accordance with the present invention are shown.

The pliers (10) is composed of a pair of metal levers pivotally connected with each other and comprises a joint, two jaws (11) and two handles (12). The structure of the pliers (10) may be conventional, so detailed description is omitted.

Figure 3:
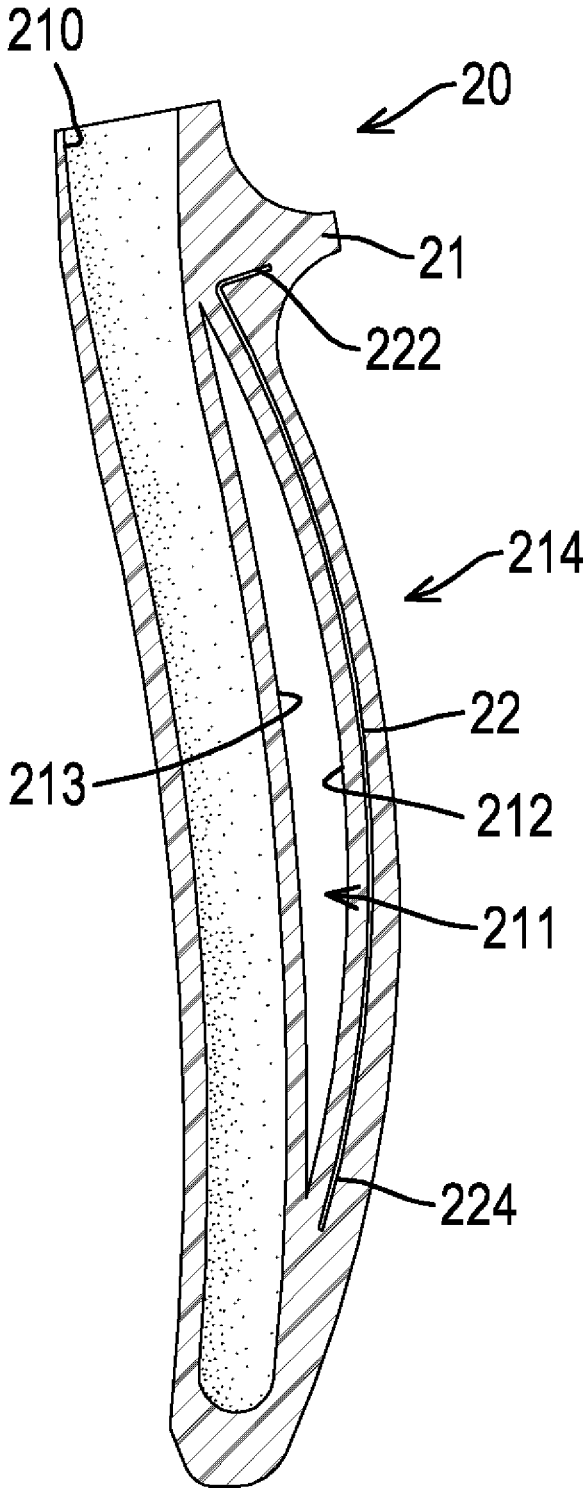
FIG. 3 is an enlarged cross sectional side view of the grip in FIG. 2.

With further reference to FIG. 3, the grips (20) are respectively mounted around the handles (12) and each grip (20) has a body (21) and a bow (22).

The body (21) is made of plastics, is mounted around the handle (12) and has a front end, a rear end, an inner side, an outer side, a handle hole (210), a cushioning hole (211), a concave surface (212), an arched surface (213) and a cushioning arm (214).

The front end of the body (21) is adjacent to the joint of the pliers (10).

The rear end of the body (21) is opposite to the front end of the body (21).

The handle hole (210) is elongated, is defined in the body (21), is mounted securely around the handle (12) and is adjacent to the inner side of the body (21).

The cushioning hole (211) is curved, is defined through the body (21), is adjacent to the outer side of the body (21), extends along the handle hole (210) and has two opposite inner sides. The cushioning hole (211) may be closed during operation.

The concave surface (212) is defined in one of the inner sides of the cushioning hole (211) and has a curvature.

The arched surface (213) is defined in the other inner side of the cushioning hole (211) and is adjacent to the handle hole (210).

The cushioning arm (214) is curved, is formed on the outer side of the body (21) and has a curvature. Preferably, the curvature of the cushioning arm (214) is same as that of the concave surface (212).

The bow (22) is flexible, is securely mounted in the cushioning arm (214), is curved and extends along the cushioning arm (214). The bow (22) is used to make the cushioning arm (214) recovering to an original position after the cushioning arm (214) is compressed and released. Preferably, the bow (22) has a bent end (222) and a hind end (224). The bent end (222) is adjacent to the front end of the body (21) and has a bent section. The bent section of the bent end (222) faces to but separates from the handle hole (210). The hind end (224) is adjacent to the rear end of the body (21) and separates from the handle hole (210).

In use, the grips (20) are grasped firmly by hands of a user and the jaws (11) hold an object. Therefore, the cushioning arms (214) and the bows (22) are compressed by the hands and are close to the handles (12). Correspondingly, the cushioning hole (211) are closed. With the bent cushioning arms (214) and the bows (22), the grips (20) are capable of cushioning and absorbing reacting force generated from the object against the jaws (11) and this can relieve pain or uncomforted feeling of the hands.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A grip for pliers comprising:

a body having an inner side;

an outer side;

a handle hole capable of being mounted around a handle of the pliers, defined in the body and adjacent to the inner side of the body;

a curved cushioning hole defined through the body, adjacent to the outer side of the body, extending along the handle hole and having two opposite inner sides;

a concave surface defined in one of the inner sides of the cushioning hole;

an arched surface defined in the other inner side of the cushioning hole and adjacent to the handle hole; and a curved cushioning arm formed on the outer side of the body; and a flexible bow securely mounted in the cushioning arm and extending along the cushioning arm.

2. The grip for pliers as claimed in claim 1, wherein the body has a front end and a rear end; and the bow has a bent end adjacent to the front end of the body and having a bent section facing to but separating from the handle hole.

3. The grip for pliers as claimed in claim 2, wherein the bow has a hind end adjacent to the rear end of the body and separating from the handle hole.

4. The grip for pliers as claimed in claim 3, wherein the concave surface has a curvature and the cushioning arm has a curvature same as that of the concave surface.

5. The grip for pliers as claimed in claim 2, wherein the concave surface has a curvature and the cushioning arm has a curvature same as that of the concave surface.

6. The grip for pliers as claimed in claim 1, wherein the concave surface has a curvature and the cushioning arm has a curvature same as that of the concave surface.

* * * * *